US009757643B2

(12) United States Patent
Rigby

(10) Patent No.: US 9,757,643 B2
(45) Date of Patent: Sep. 12, 2017

(54) BOARD GAME SCORING ASSISTIVE DEVICE

(71) Applicant: William Roger Rigby, Spring Hope, NC (US)

(72) Inventor: William Roger Rigby, Spring Hope, NC (US)

(73) Assignee: Board Game Innovation, LLC, Spring Hope, NC (US)

( * ) Notice: Subject to any disclaimer, the term of this patent is extended or adjusted under 35 U.S.C. 154(b) by 0 days.

(21) Appl. No.: 14/192,848

(22) Filed: Feb. 27, 2014

(65) Prior Publication Data

US 2015/0238853 A1 Aug. 27, 2015

(51) Int. Cl.

*A63F 3/00* (2006.01)
*A63F 11/00* (2006.01)
*A63F 9/04* (2006.01)

(52) U.S. Cl.

CPC ..... *A63F 11/0051* (2013.01); *A63F 9/0495* (2013.01); *A63F 2003/0093* (2013.01); *A63F 2003/00886* (2013.01); *A63F 2011/0055* (2013.01); *A63F 2011/0067* (2013.01)

(58) Field of Classification Search

CPC ..... A63F 2003/0093; A63F 2011/0067; A63F 2003/00886; A63F 11/0051; A63F 9/0495; A63F 2011/0055

USPC ..... 273/275, 276, 281, 282.1, 282.3, 289, 273/290

See application file for complete search history.

(56) References Cited

U.S. PATENT DOCUMENTS 3,516,671 A * 6/1970 Estrin ..... A63F 3/0421 273/238
3,695,615 A * 10/1972 Shoptaugh ..... A63F 3/00574 273/157 R
3,791,649 A * 2/1974 Gold ..... 273/239
4,074,907 A * 2/1978 Curtis ..... A63F 9/10 273/273
4,146,234 A * 3/1979 Le Floch ..... A63F 3/00697 273/261
4,183,167 A * 1/1980 Jatich ..... A63F 9/0073 446/118
4,248,433 A * 2/1981 Soriano ..... A63F 9/28 273/275
4,254,957 A * 3/1981 Kramer ..... A63F 3/00574 273/271
4,974,849 A * 12/1990 Kasuya ..... A63F 9/10 273/157 R
6,199,863 B1 * 3/2001 Chan ..... A63F 3/0423 273/148 R
D448,051 S * 9/2001 Wilkinson ..... D21/338
6,789,798 B1 9/2004 Adams
7,255,348 B1 8/2007 Shaffer
7,530,571 B1 5/2009 Bell
7,810,814 B1 10/2010 Chapman et al.

(Continued)

*Primary Examiner* — Vishu Mendiratta

(57) ABSTRACT

A board game scoring assistive device having a panel that includes one or more apertures accommodating a player game piece or token and a particular manner keeping it positioned over the proper area or score, especially when the game piece is sized so that it covers more than just a single scoring position. This invention helps to alleviate the questions of which position the piece is in as well as where the piece had been in the event of an accidental jolt to the scoring area.

6 Claims, 12 Drawing Sheets

(56) References Cited

U.S. PATENT DOCUMENTS

| | | | | |
|---|---|---|---|---|
| 8,403,328 | B2 * | 3/2013 | Vandoren | A63F 3/00634 273/241 |
| 2010/0237561 | A1 * | 9/2010 | Cheng | A63F 9/10 273/157 R |
| 2013/0277914 | A1 * | 10/2013 | Cheng | A63F 3/00574 273/287 |

* cited by examiner

BOARD GAME SCORING ASSISTIVE DEVICE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

Field of the Invention

This invention relates to an acrylic overlay that has been laser cut with an orientation slot to accommodate a board game scoring cube. The overlay, after having been placed over the player mat score sheet from a board game and aligned with the graphics printed on the player mat, allows the player to insert the scoring cube into the proper location. The overlay then provides alignment and retention mechanisms to prevent the cube from unintentionally moving. This is especially useful when the scoring cube is larger than the scoring location spacing printed on the player mat, helping to alleviate scoring ambiguity.

DESCRIPTION OF THE RELATED ART

It is known, in board games to make use of an orientation slot to position cubes for game play. Exemplary of such prior art is U.S. Pat. No. 6,199,863 ('863) to Wai Man Chan, entitled "Cubes and tray game set with display means". While these prior art cubes and tray sets provide adequate positioning and retention of the player cubes in a rotated or tilted face orientation they only provide initial horizontal alignment of cubes placed parallel to sides of the orientation slot. These horizontally aligned cubes would be free to move longitudinally along the length of the orientation slot losing their position. A more advantageous orientation slot would incorporate retention hooks into the slot geometry preventing horizontally aligned cubes from significant longitudinal encroachment into the rotated spaces that neighbor them.

It is also known in the prior art to demonstrate the use of a gridded lattice to position cubes for play. Exemplary of such prior art is U.S. Pat. No. 4,244,580 ('580) to Francis X. Hoyles, entitled "Multivariant board game apparatus". Even though the '580 patent teaches individualized gridded spacing that would both position and maintain cube placement integrity, it will not accommodate cube placements in close proximity that either eliminate the grid or make it unsustainably small and difficult to manufacture and maintain. A more compact alignment grid would incorporate offset or rotated recesses creating an orientation slot along with retention hooks allowing for closer and even overlapping cube placement locations.

It is apparent from the above references that a need exists in the art for a Board Game Scoring Assistive Device which is able to both position and maintain a players scoring piece in close and/or overlapping positions.

It is a purpose of this invention to fulfill this and other needs in the art in a manner more apparent to the skilled artisan once given the following disclosure.

BRIEF SUMMARY OF THE INVENTION

Generally speaking this invention fulfills these needs by providing a board game scoring assistive device having a sheet of acrylic that contains either a single or series of orientation slots that are appropriately configured to accommodate a board game playing piece in circumstances where the needed positions are in close proximity to one another, providing accurate initial placement, while securing against being able to slide from one position to the next unintentionally through the inclusion of retention hooks.

In certain preferred embodiments the orientation slots may be cut-out areas. Also the orientation slots may be partially engraved or recessed into the sheet material.

In another further preferred embodiment the acrylic sheet material containing the orientation slots are attached to an additional sheet of material to provide support for the board game pieces.

In another preferred embodiment the acrylic sheet material containing the orientation slots is integrated into a frame assembly providing a space whereby the player card is inserted behind the assistive device orientation panel.

Furthermore an additional preferred embodiment would add a containment device over the game piece in each of the above embodiments to hold the piece in place during storage or transport.

The preferred board game scoring assistive device, according to this invention, offers the following advantages: ease of use, resistance to accidental movement of the game pieces, efficient use of space, ability to match demanding artwork, and superb economy. In many of the preferred embodiments, in fact, these attributes of ease of use, resistance to accidental movement of the game pieces, efficient use of space, ability to match demanding artwork, and superb economy have been elevated well above that which has been achieved in previous board game scoring assistive devices.

DETAILED DESCRIPTION OF THE INVENTION

Figure 1:
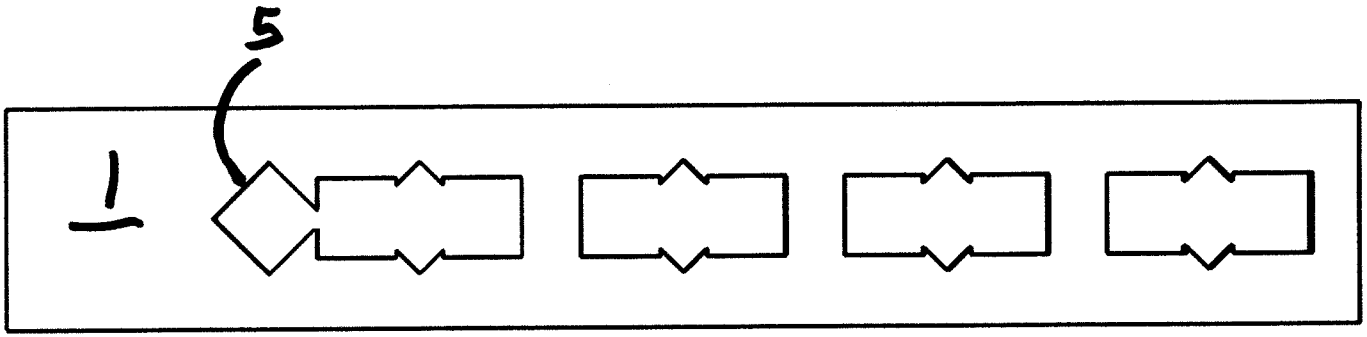
FIG. 1 is a plan view of an acrylic board game scoring assistive device with retention hook orientation slots, according to the present invention.

Acrylic is used as a substrate for board game scoring assistive device pattern 1 (FIG. 1), pattern 200 (FIG. 6), and pattern 300 (FIG. 9), and, is typically constructed of a sheet of cast or extruded acrylic of thicknesses ranging from 1 to 4 mm and has been cut utilizing a carbon dioxide laser. This invention is not limited for use with Acrylic, it is relevant to any sheet material, for instance, plywood, paperboard, corrugated paper, balsa wood, solid wood or leather. Any material molded or machined into the disclosed pattern could also be used, such as plastic, metal, rubber, or paper pulp. The method of cutting the pattern in the sheet material is also not limited to laser, but may also be cut with a saw, router, water jet, plasma cutter, plattern or rotary die-cutter, or other mechanisms known in the art.

When used for board game scoring assistive device stock, the acrylic is usually transparent and colorless, this allows for any illustrative artwork on the surface of player mat 2 (FIG. 5) to be visible through pattern 1. If however, artistic needs dictate, colored and/or translucent/transparent acrylic may be used.

Figure 2:
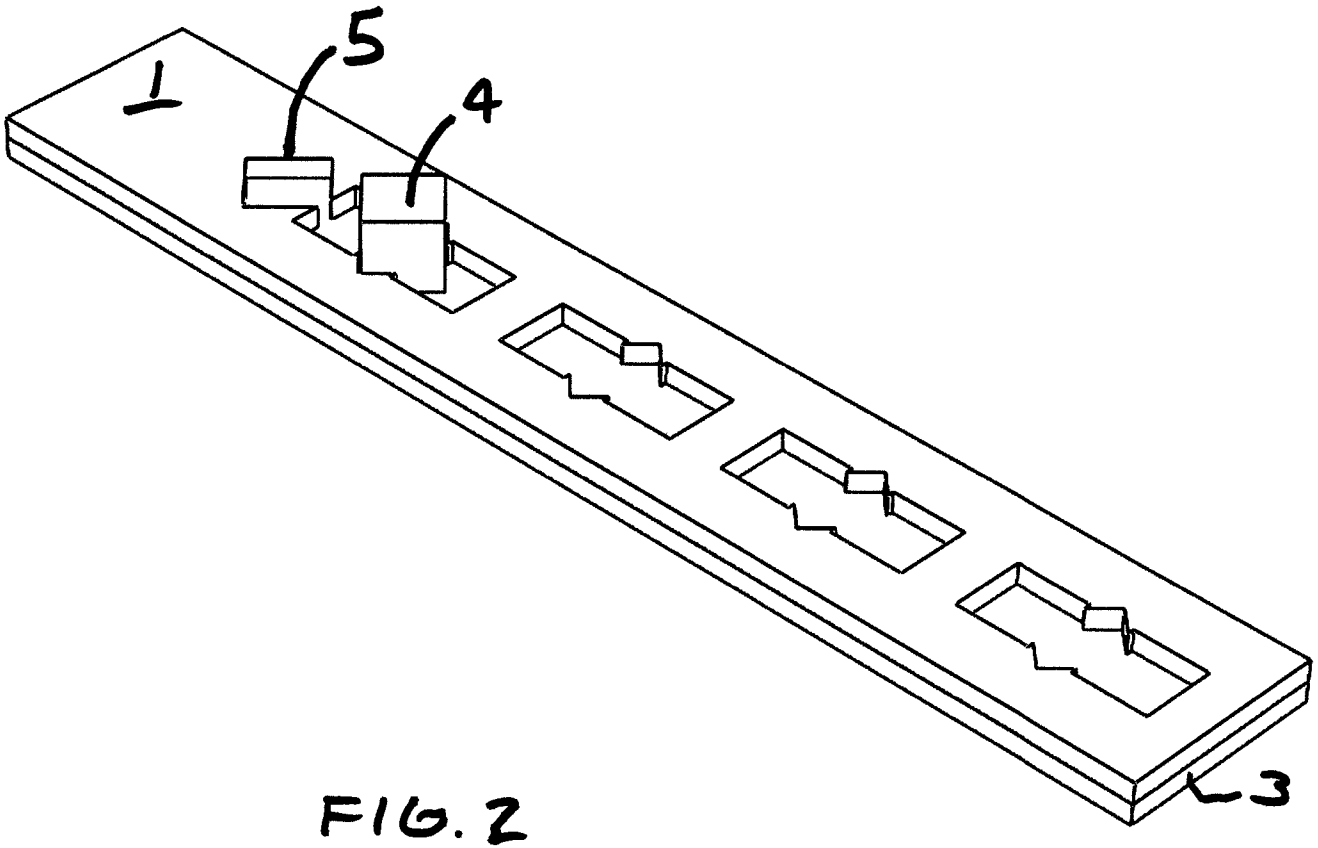
FIG. 2 is an isometric view of an acrylic board game scoring assistive device with retention hook orientation slots, attached above a supportive sheet, with a game scoring cube placed in a horizontal orientation. according to the present invention.

As shown in FIG. 2, pattern 1 has been attached to supportive sheet 3. Supportive sheet 3 can be constructed from any materials listed above. The materials of pattern 1 and supportive sheet 3 may be of similar or different; substrate, thickness, and decoration. Scoring cube 4 is positioned in a rotated orientation notch inside of orientation slot 5.

Figure 10:
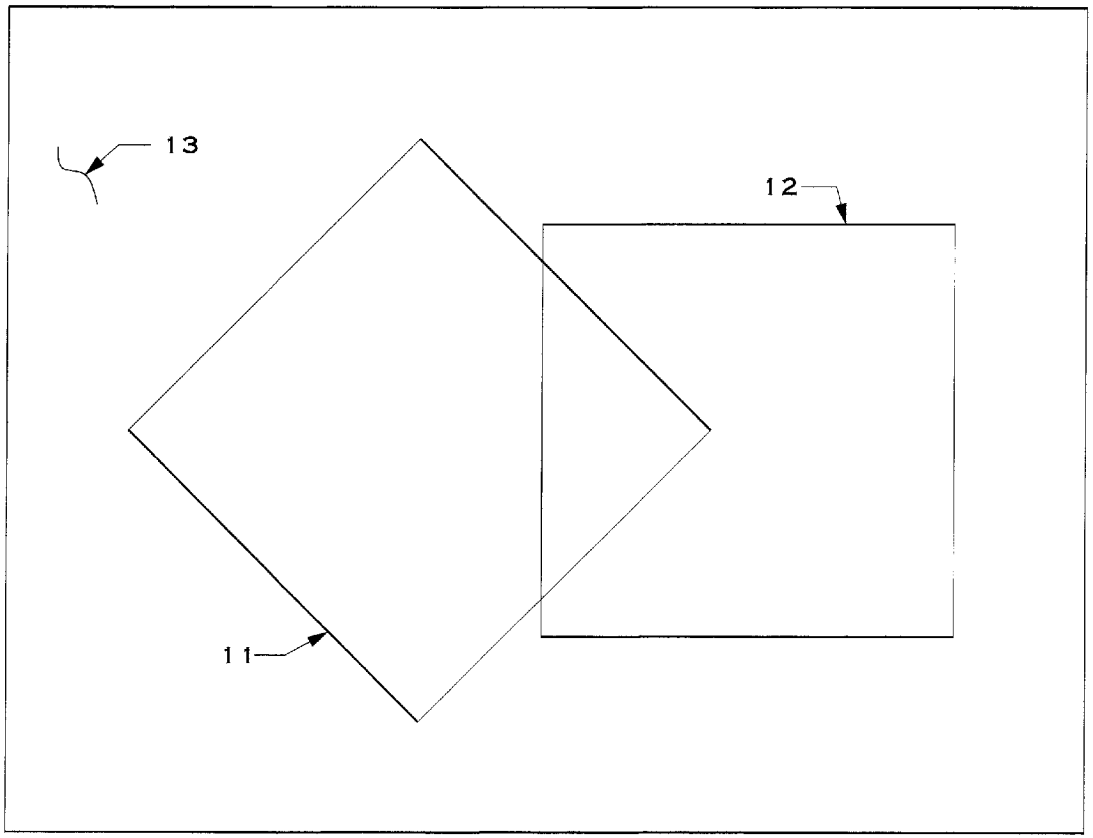
FIG. 10 is a plan view of an acrylic board game scoring assistive device showing placement of overlapping orientation notches.

As shown in FIG. 10, the primary orientation notch 11 and the secondary orientation notch 12 have been positioned to intersect one another on the planar face of base member 13.

Figure 11:
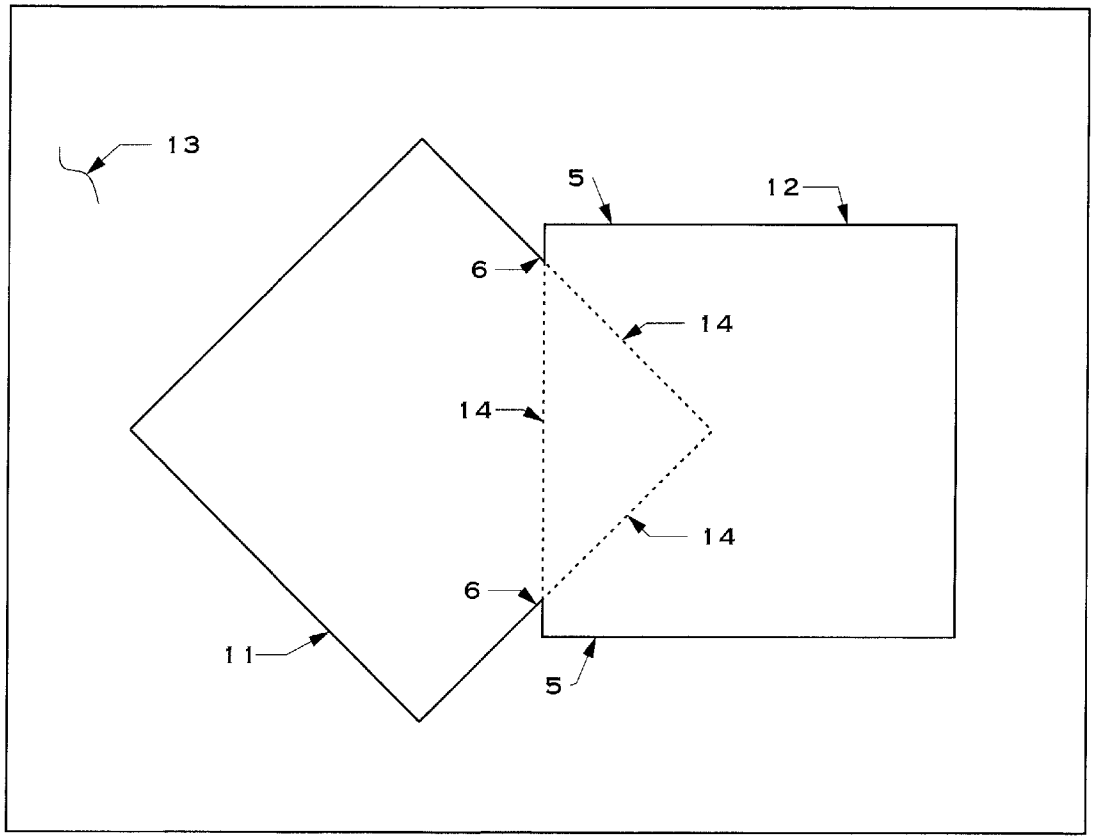
FIG. 11 is a plan view of an acrylic board game scoring assistive device highlighting the area of overlap between the orientation notches.

FIG. 11 shows dashed lines 14 where primary orientation notch 11 and secondary orientation notch 12 overlap, defining the area of intersection. Once the dashed lines 14 have been removed, the remaining geometric pattern from the primary and secondary orientation notches 11 and 12 respectively combine to form the orientation slot 5. The retention hooks 6 can be seen adjoining the area of intersection protruding inward towards the opposing edge of the orientation slot 5, which in this preferred embodiment is also a second retention hook 6.

Figure 12:
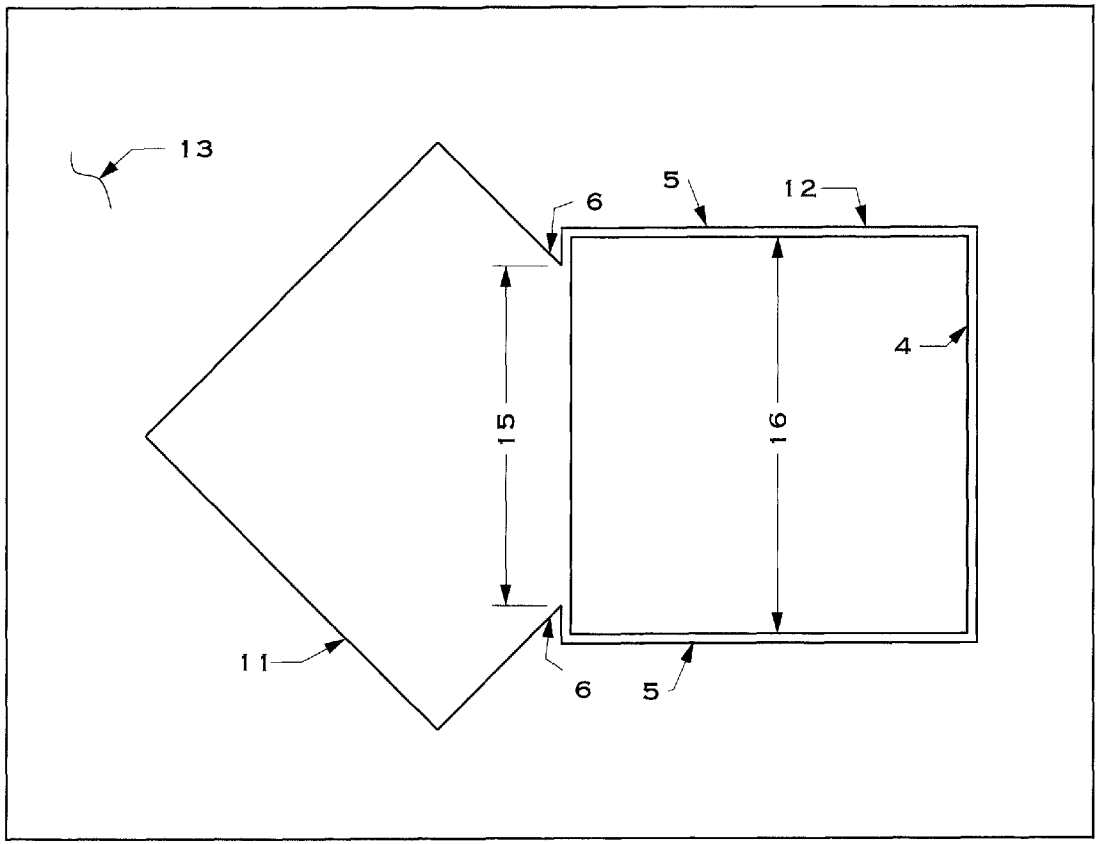
FIG. 12 is a plan view of an acrylic board game scoring assistive device showing the placement of a non-rotated game piece with associated explanatory dimensions of the game piece and the void created by two retention hooks.

As shown in FIG. 12, a non-rotated game piece, scoring cube 4, has been placed inside of the orientation slot 5, positioned in what was once the secondary orientation notch 12, retention hooks 6 can be seen protruding into the orientation slot towards the opposing edge of the orientation slot 5. The protruding retention hooks 6 being separated from the opposing edge of the orientation slot by a void space 15 not greater the smallest dimension of the game piece when viewed from above 16, in this preferred embodiment, said smallest dimension of the game piece is the width across the face of the cube instead of the diagonal.

Figure 3:
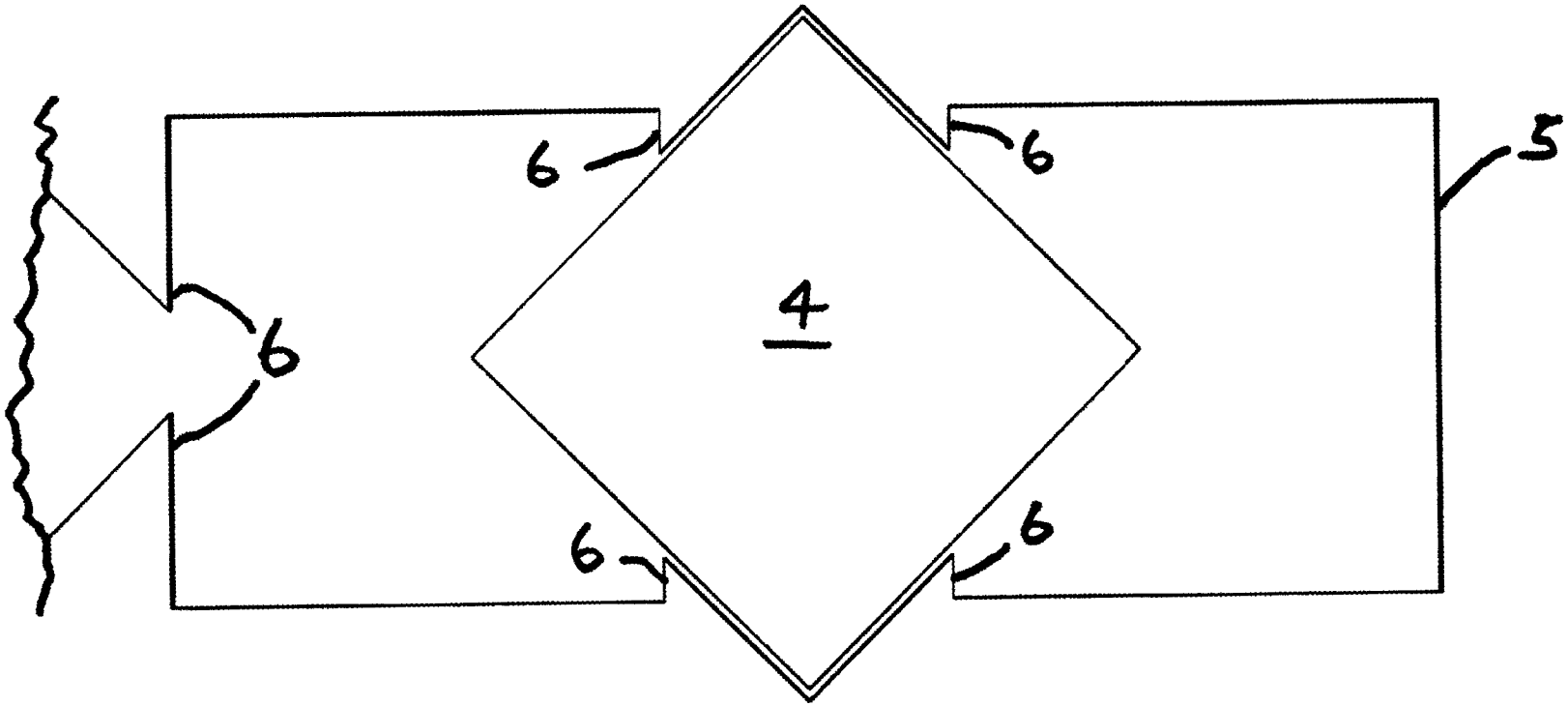
FIG. 3 is an enlarged partial plan view of an acrylic board game scoring assistive device with retention hook orientation slots, with a game scoring cube placed in a rotated orientation.

As shown in FIG. 3, scoring cube 4 has been set in a rotated notch in orientation slot 5. Cube 4 is prevented from lateral movement by retention hooks 6 which are formed by intersecting the overlapping orientation notch perimeters from rotated and non-rotated orientations of cube 4.

Figure 4:
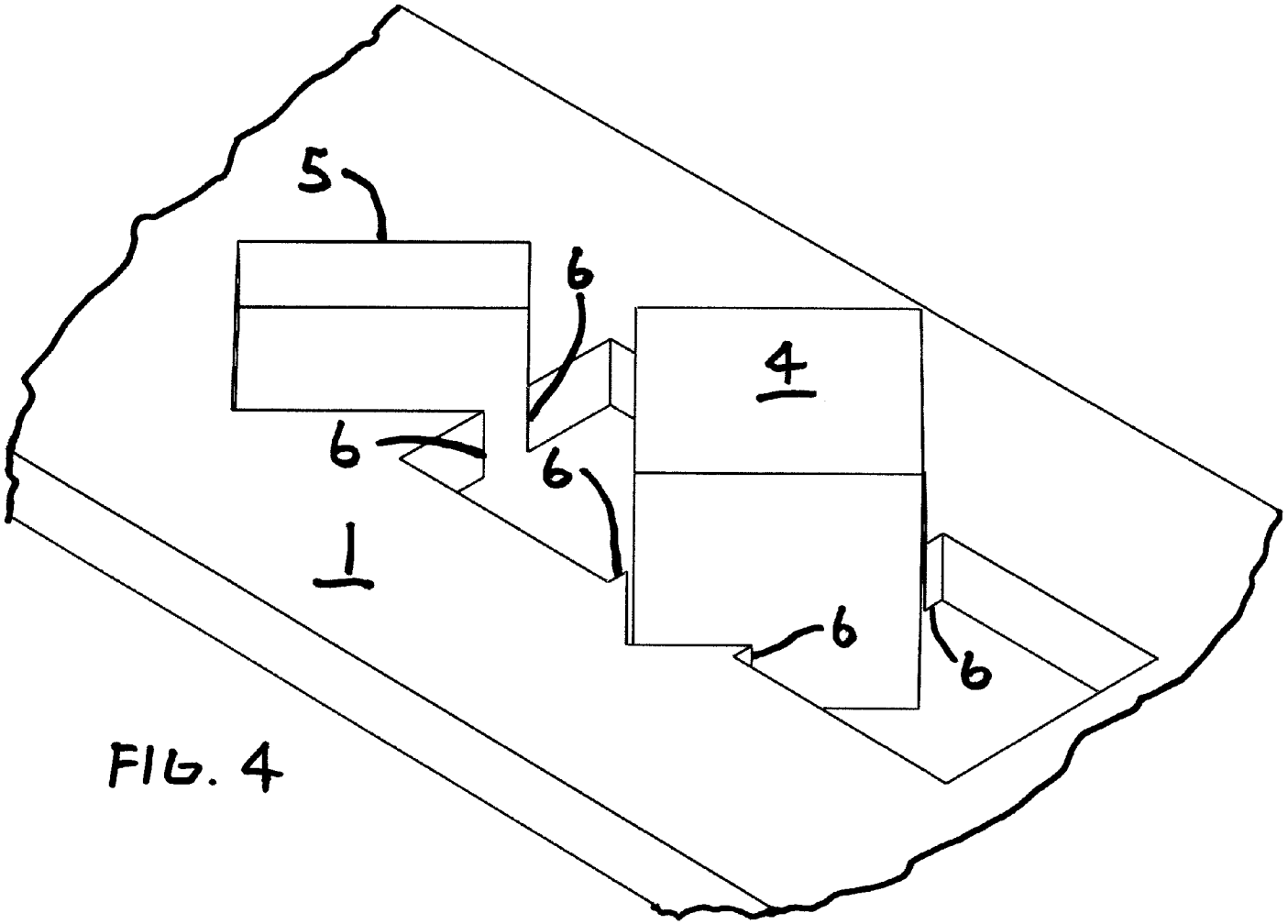
FIG. 4 is an enlarged isometric view of FIG. 3, according to the present invention.

With respect to FIG. 4, the interaction between scoring cube 4 and retention hooks 6 can be more easily seen.

Figure 5:
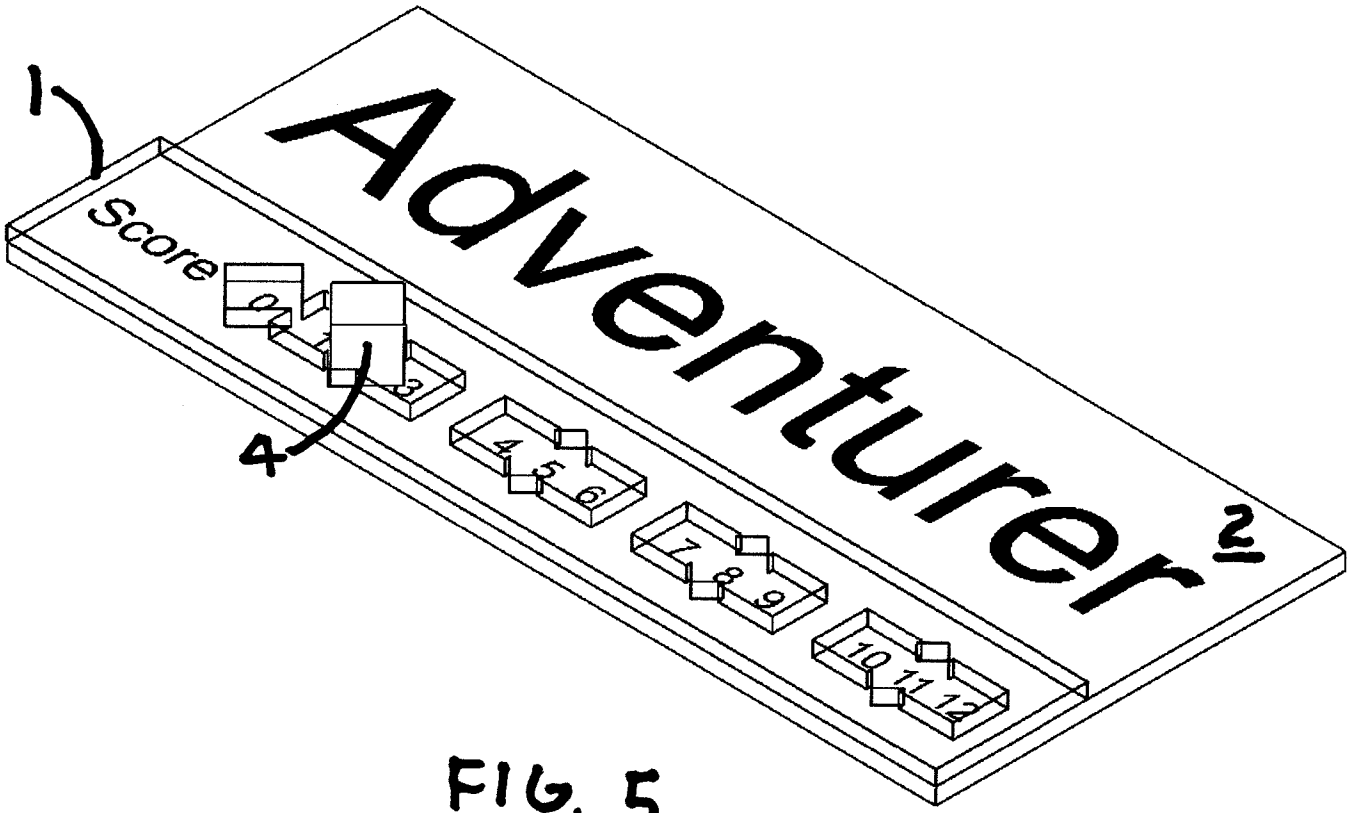
FIG. 5 is an isometric view of an acrylic board game scoring assistive device with retention hook orientation slots, (shown transparently), placed above a player mat, with a game scoring cube placed in a rotated orientation. according to the present invention.

With respect to FIG. 5, pattern 1, (displayed in transparency), has been placed on top of player mat 2, and aligned with the scoring illustration artwork. Player mat 2 is typically constructed of printed paperboard and may contain a variety of scoring or record keeping positions and patterns as dictated by the game designer.

Figure 6:
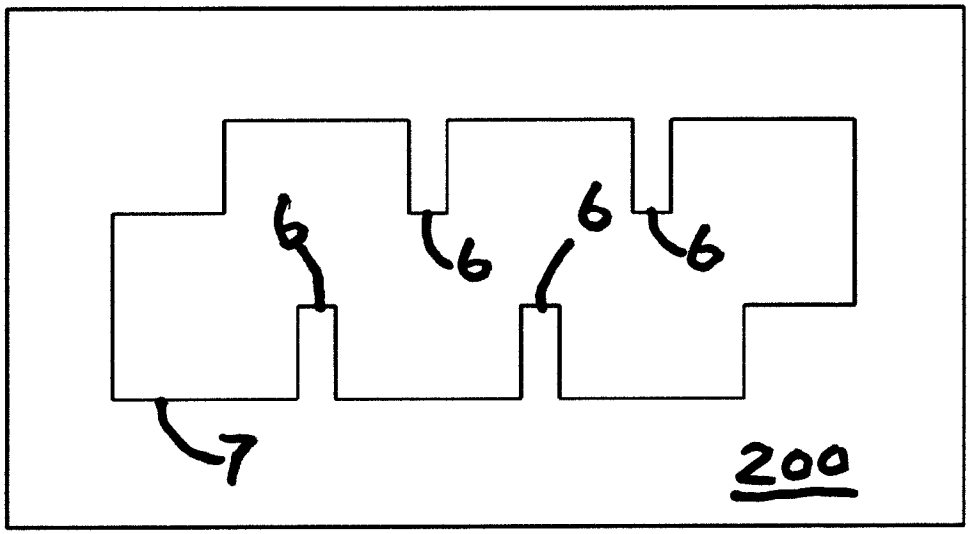
FIG. 6 is a plan view of an acrylic board game scoring assistive device with retention post orientation slots, according to the present invention.

With respect to FIG. 6, this illustrates how pattern 200 has been laser cut in an alternate configuration of orientation slot 7 by offsetting, instead of rotating the cube pattern as shown in FIGS. 1-5, resulting in retention post 6.

Figure 7:
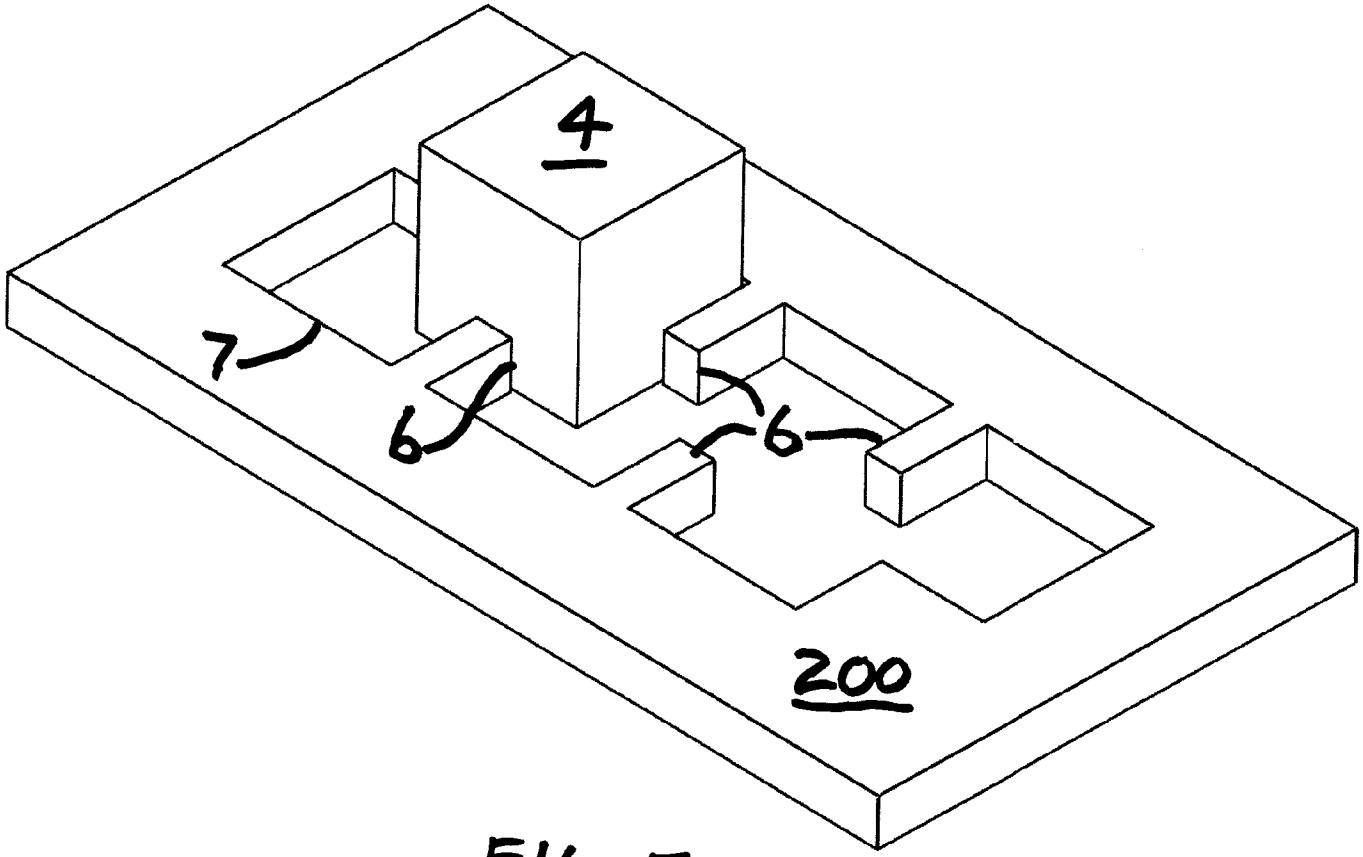
FIG. 7 is an isometric view of FIG. 6, according to the present invention.

With respect to FIG. 7, this illustrates how scoring cube 4 is held in location by the retention post 6, within the orientation slot 7.

Figure 8:
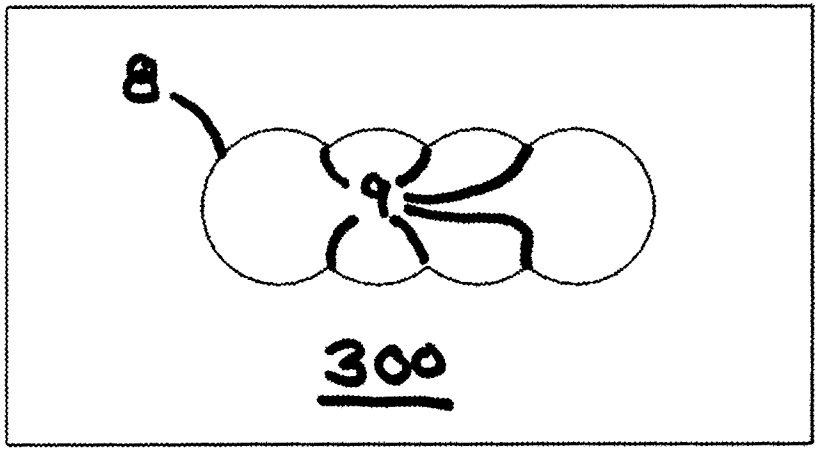
FIG. 8 is a plan view of an acrylic board game scoring assistive device with retention waist orientation slots, according to the present invention.

As shown in FIG. 8, pattern 300, contains orientation slot 8 which is made up of intersecting arcs. When the arcs intersect they create a waist 9.

Figure 9:
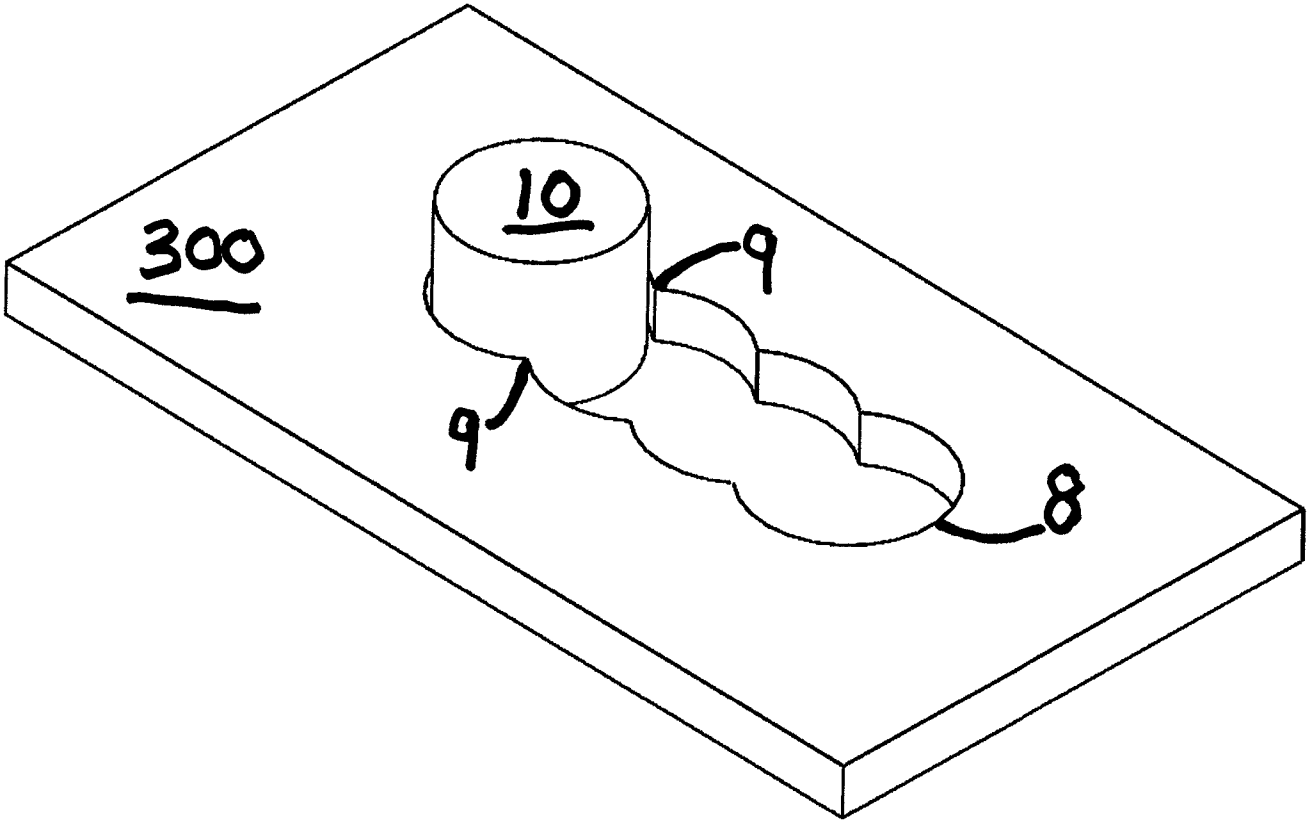
FIG. 9 is an isometric view of FIG. 8, with an added cylinder scoring piece according to the present invention.

As shown in FIG. 9, a scoring cylinder 10 is kept from moving longitudinally in orientation slot 8 by at least one waist 9.

In other embodiments (not shown), a containment device is added to maintain the scoring game piece or pieces in the orientation slot for transport or storage. This device made of either sheet material or a mold construct would be placed over the top of the game piece that has been placed into the orientation slot between the supporting sheet is held in place with an elastic band or similar device known in the art.

In another embodiment (not shown), the board game scoring assistive device is constructed from an illustrated sheet of paperboard or the like and fusibly attached to a player card that has also been illustrated forming a scoring assembly.

Although FIGS. 1-9 show orientation slots based on geometries of squares and circles in semi-linear orientation, other layouts are also contemplated. For example triangle shaped game pieces arranged in a circular fashion.

What is claimed is:

1. A board game scoring device comprising:

a base member sized and configured to rest on a score sheet of a board game, the base member having an upper surface, a bottom surface;

a board game scoring cube having a perimeter comprising the sum of the four sides of the board game scoring cube and the cube having a center;

at least two overlapping openings within the base member sized to partially receive the board game scoring cube, the first opening shaped by the cube perimeter in a first position, and the second opening shaped by the cube perimeter being linearly advanced from the first position and simultaneously rotated about the cube center at an angle from between 30 to 90 degrees to a second position;

scoring cube retention mechanism forming a protuberance extending into the opening, each retention mechanism shaped by a first edge and a second intersecting edge, the first edge being an extension of the cube perimeter in the first position and the second edge being an extension of the cube in the second adjacent position, whereby the scoring cube retention mechanism secures the position of the board game scoring cube within the base member in both positions, and the second adjacent opening will not receive the scoring cube when the cube is received into the first opening.

2. The device of claim 1 wherein the base member is transparent.

3. The device of claim 1 wherein the board game is a score sheet.

4. The device of claim 1 wherein the board game cube is a scoring piece.

5. The device of claim 1 wherein a player advances the board game cube within the base by removing the piece from a first opening perimeter and placing it in the adjacent overlapping opening perimeter in the direction of advancement as directed by the board game.

6. The device of claim 5 wherein the direction of advancement is directed by the board game score sheet.

* * * * *